US008544667B2

(12) United States Patent
Ozawa et al.

(10) Patent No.: US 8,544,667 B2
(45) Date of Patent: Oct. 1, 2013

(54) ROUND SYNTHETIC RESIN BOTTLE

(75) Inventors: Tomoyuki Ozawa, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 221 days.

(21) Appl. No.: 12/312,151

(22) PCT Filed: Nov. 2, 2007

(86) PCT No.: PCT/JP2007/071364

§ 371 (c)(1),
(2), (4) Date: May 28, 2009

(87) PCT Pub. No.: WO2008/065850

PCT Pub. Date: Jun. 5, 2008

(65) Prior Publication Data

US 2010/0032405 A1 Feb. 11, 2010

(30) Foreign Application Priority Data

Nov. 29, 2006 (JP) ..... 2006-322021

(51) Int. Cl.

| | |
|---|---|
| ***B65D 90/02*** | (2006.01) |
| ***B65D 6/00*** | (2006.01) |
| ***B65D 8/04*** | (2006.01) |
| ***B65D 8/18*** | (2006.01) |

(52) U.S. Cl.
USPC ..... 215/381; 215/382; 215/383; 220/670; 220/672; 220/674

(58) Field of Classification Search
USPC ..... 215/381, 382, 383; 220/670, 672, 220/674
See application file for complete search history.

(56) References Cited

U.S. PATENT DOCUMENTS

| | | | | |
|---|---|---|---|---|
| 5,178,289 | A * | 1/1993 | Krishnakumar et al. | 215/382 |
| 5,704,504 | A * | 1/1998 | Bueno | 215/381 |
| 6,779,673 | B2 * | 8/2004 | Melrose et al. | 215/381 |
| 2004/0195199 | A1 * | 10/2004 | Maki et al. | 215/381 |
| 2005/0269284 | A1 | 12/2005 | Pedmo et al. | |
| 2006/0289378 | A1 * | 12/2006 | Zhang | 215/381 |

FOREIGN PATENT DOCUMENTS

| | | |
|---|---|---|
| JP | A-60-179605 | 9/1985 |
| JP | A-10-058527 | 3/1998 |
| JP | A-2000-062743 | 2/2000 |

* cited by examiner

*Primary Examiner* — Anthony Stashick
*Assistant Examiner* — Andrew T Kirsch
(74) *Attorney, Agent, or Firm* — Oliff & Berridge, PLC

(57) ABSTRACT

A round bottle that gives an overall impression of a slim body, while maintaining a basic shape of the round bottle and a vacuum absorbing function. An object is to provide a round synthetic resin bottle having a differentiated shape not found in conventional art. This involves narrowing down a diameter of the body in a tapered manner toward a middle height position of the body to form a tapered portion at either one of an upper end or a lower end of the basically cylindrical body and thus to form a waist portion in a narrowest part of this tapered portion, and forming a plurality of dented vacuum absorbing panels in a height range lying next to the waist portion of the body and in a configuration that each of the panels is disposed in parallel in a circumferential direction and dented by a stepped portion surrounding each panel.

9 Claims, 3 Drawing Sheets

ROUND SYNTHETIC RESIN BOTTLE

TECHNICAL FIELD

This invention relates to a round synthetic resin bottle, represented by a biaxially drawn, blow-molded bottle made of a polyethylene terephthalate resin, wherein the body of the bottle is provided with a plurality of vacuum absorbing panels in a dented shape disposed in parallel in a circumferential direction.

BACKGROUND ART

Synthetic resin bottles utilizing a polyethylene terephthalate resin (hereinafter referred to as PET resin) are widely in use as the containers for water, sport drinks, teas, and juices. For example, patent document 1 describes a round bottle that has long been in use for the above-described applications. FIG. 3 shows a typical shape of the round bottle. The round bottle 1 comprises a body 4 basically in a cylindrical shape and a neck 2 standing on a shoulder 3 which is directly disposed on the body 4. This body 4 has a plurality of vacuum absorbing panels 12 disposed in parallel in a circumferential direction and dented by a stepped portion 10 surrounding each panel, with pillars 11 being left in between. For the applications in which the bottles are filled with contents and heated to a high temperature in a range of 80 to 90 degrees C. for a purpose of sterilization, the pressure inside each bottle would become reduced along with a decrease in temperature. The vacuum absorbing panels 12 show a so-called vacuum absorbing function, as they prevent the body 4 from local deformation under a depressurized condition, or prevent local deformation from becoming conspicuous outwardly.

[Patent document 1] Published patent application JP1998-58527

DISCLOSURE OF THE INVENTION

Problem to be Solved by this Invention

A technical problem to be solved by this invention is to create a round bottle in a shape that would give an overall impression of a slim body while maintaining the appearance of a round bottle and the vacuum absorbing function. An object of this invention is to provide a round synthetic resin bottle having a differentiated shape not found in conventional art.

Means of Solving the Problem

The means of carrying out the invention according to embodiment 1 to solve the above-described technical problem involves narrowing down a diameter of the body at a relatively steep angle in a tapered manner toward a middle height position of the body to form a tapered portion at either one of an upper end or a lower end of the basically cylindrical body and to form a waist portion in a narrowest part of this tapered portion, and forming a plurality of dented vacuum absorbing panels in a portion of the body adjacent to the tapered portion, the waist portion being a boundary between the plurality of dented vacuum absorbing panels and the tapered portion, the portion of the body having the plurality of dented vacuum absorbing panels being tapered by narrowing down the diameter of the body at a gentle angle toward the wait portion and in a configuration that each of the panels is disposed in parallel in a circumferential direction and dented by a stepped portion 10 surrounding each panel.

If conventional bottles are given an overall impression of a slim body (hereinafter referred to as the impression of slimness), the waist portion has been formed at a roughly middle height position of the body by narrowing down the diameter of the body gradually from both the upper and lower ends of the body. In that case, the waist portion has to be formed in the area where there should be vacuum absorbing panels. Thus, the panels are divided into upper and lower portions, preventing the vacuum absorbing function from getting into full action. There arises also a problem of disfigurement.

Under the above-described construction according to embodiment 1, the waist portion is formed by making the tapered portion disposed at either the upper or lower end of the body. Therefore, the vacuum absorbing panels can be disposed, without being divided, in a sufficient height range excluding the tapered portion. The whole panels thus obtained are allowed to perform the vacuum absorbing function to the fullest extent.

The tapered portion is tapered at a relatively steep angle. The user can get firm hold of the bottle by putting the thumb and fingers in the vicinities of the waist portion so that the bottle would not slip off.

The tapered portion is an area of the body where there is no uneven surface associated with the vacuum absorbing panels. In addition, since this tapered portion has a relatively steep slope in a limited height range, the shape of this portion is clearly recognizable. Whether the tapered portion is formed at the upper end or the lower end of the body, it helps create a sufficient impression of slimness.

If the tapered portion is disposed at the upper end of the body, the waist portion is naturally formed in the upper end area of the body. In that case, the body narrows down from the upper end to the waist portion over the tapered portion. At the same time, the body is also tapered from the lower end to the waist portion however gradual the angle is. The vacuum absorbing panels are formed in this gradually tapered area of the body. Since the body broadens in one direction from the waist portion to the lower end of the body, the vacuum absorbing panels disposed in this gradually tapered area would not damage the vacuum absorbing function.

The means of carrying out the invention according to embodiment 2 comprises that, in the invention according to embodiment 1, the tapered portion has a height accounting for 15% or less of a body height and a minimum diameter in a range of 75% to 95% of a maximum diameter.

Under the above construction of embodiment 2, it is preferred that the tapered portion has a height of 15% or less of the body height so that the vacuum absorbing function may be performed sufficiently. This is because, if the tapered portion has a height larger than this level, surely it would be able to emphasize the impression of slimness, but there has to be a correspondingly limited height range afforded to form the vacuum absorbing panels. In view of the effects on the possible impression of slimness and the bottle capacity, preferably the tapered portion has a minimum diameter ranging from 75% to 95% of the maximum diameter.

The means of carrying out the invention according to embodiment 3 comprises that, in the invention according to embodiment 1 or 2, the vacuum absorbing panels are inclined uniformly in a certain direction.

Under the above construction of embodiment 3, the vacuum absorbing panels, when inclined, are not only deformed into a dented state, as caused by the depressurization occurring inside the body, but also the diameter of the body is narrowed down due to twisting deformation in the area of the body where there are the inclined panels. Because of this twist, the panels perform the vacuum absorbing function to an even higher extent. This higher extent is considered as complementary to a decrease in the height range in which the vacuum absorbing panels are acceptable, as the decrease is inevitably brought about by forming the tapered portion.

The means of carrying out the invention according to embodiment 4 comprises that, in the invention according to embodiment 1, 2, or 3, the tapered portion is disposed on the side of the middle height position of the body, as looked from upper and lower circumferential grooves formed at the upper and lower ends of the body.

Under the above construction of embodiment 4, the progress of deformation caused by volume reduction at the time of depressurization can be effectively prevented by the circumferential grooves formed at the upper and lower ends of the body. These grooves help the bottle secure and maintain the appearance of the round bottle, the adaptability to production lines, and other functions.

Effects of the Invention

This invention having the afore-mentioned construction has the following effects: According to the invention of embodiment 1, the waist portion is formed by making the tapered portion disposed at either the upper or lower end of the body. Therefore, it is possible for the vacuum absorbing panels to be disposed in a sufficient height range except for the tapered portion, without being divided into upper and lower panels. The whole panels thus obtained are allowed to perform the vacuum absorbing function to the fullest extent.

The tapered portion is an area of the body where there is no uneven surface associated with the vacuum absorbing panels. What is more, since this tapered portion is formed at a relatively steep angle in a limited height range, the shape of this portion is clearly recognizable. Whether this tapered portion is formed at the upper end or the lower end of the body, it helps create a sufficient impression of slimness.

With the tapered portion having a relatively steep angle, the user can get firm hold of the bottle by putting the thumb and fingers in the vicinities of the waist portion, so that the bottle would never slip off.

According to the invention of embodiment 2, the vacuum absorbing function can be fully performed by setting the height of the tapered portion at 15% or less of the body height. The impression of slimness can be created with no regard to bottle capacity, by limiting the extent of reduction in diameter to a range of 75% to 95% of the maximum bottle diameter According to the invention of embodiment 3, the inclined vacuum absorbing panels are not only deformed into a dented state, as caused by the depressurization occurring inside the body, but also the diameter of the body is narrowed down due to twisting deformation. Because of this twist, the panels perform the vacuum absorbing function to an even higher extent. This higher extent is considered as complementary to a decrease in the height range in which the vacuum absorbing panels are acceptable, as the decrease is inevitably brought about by forming the tapered portion.

According to the invention of embodiment 4, the progress of deformation caused by volume reduction at the time of depressurization can be effectively prevented by the circumferential grooves formed at the upper and lower ends of the body. These grooves help the bottle secure and maintain the appearance of the round bottle, the adaptability to production lines, and other functions.

DESCRIPTION OF REFERENCE SIGNS

Figure 1:
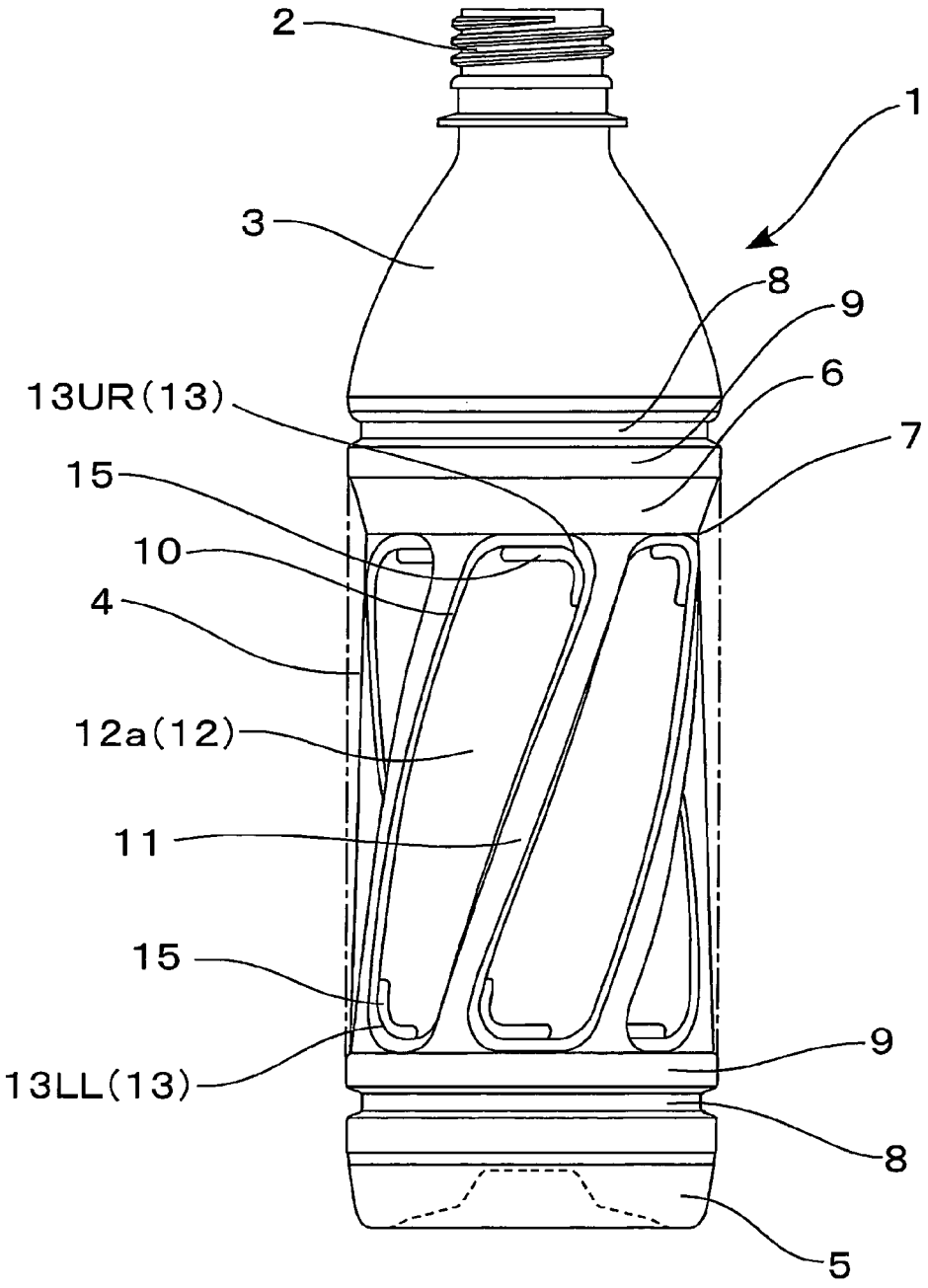
FIG. 1 is a front elevational view of the entire bottle in the first embodiment of this invention.

1. Bottle
2. Neck
3. Shoulder
4. Body
5. Bottom
6. Tapered portion
7. Waist portion
8. Circumferential groove
9. Ring portion
10. Stepped portion
11. Pillar
12. Vacuum absorbing panel
12*a*. Inclined vacuum absorbing panel
13. Corner
13. UR, 13LL. Upper right corner; Lower left corner
15. Corner groove

MOST PREFERRED EMBODIMENTS FOR CARRYING OUT THE INVENTION

This invention is further described with respect to preferred embodiments, now referring to the drawings. FIG. 1 is a front elevational view of the entire round synthetic resin bottle in the first embodiment of this invention. The bottle 1 in this embodiment is a biaxially drawn, blow-molded product made of a PET resin, and has a height of 215 mm, a diameter of the body 4 of 66 mm, and a nominal capacity of 500 ml. This bottle 1 comprises a basically cylindrical body 4, a shoulder 3 in a roughly semi-spherical shape disposed on an upper end of this body 4, a cylindrical neck 2 disposed on the shoulder 3 and provided with a spiral thread and a neck ring on the outer surface of the neck 2, and a bottom 5 disposed at a lower end of the body 4. And a central portion of the bottom wall is caved-in.

Circumferential grooves 8 are formed at the upper and lower ends of the body 4 to make them perform the function of circumferential ribs. Ring portions 9 are the portions remaining cylindrical as the basic shape of the round body 4, and are disposed right under the upper circumferential groove 8 and right on the lower circumferential groove 8. The tapered portion 6 is disposed right under the upper ring portion 9 and is narrowed down at a relatively steep angle in the direction of the middle height position of the body 4 (i.e., narrowing downward in this embodiment).

The portion of the body 4 extending from right above the lower ring portion 9 to the position of the tapered portion 6 having the narrowest diameter is also narrowed down gradually in a tapered manner. The boundary between the portion of the body 4 and the tapered portion 6 forms a waist portion 7. On the whole, the body 4 has the waist portion 7 and thus looks slim.

In this portion of the body 4 extending from right above the lower ring portion 9 to the waist portion 7, where the body 4 is gradually narrowed down upward, there are six inclined vacuum absorbing panels 12*a*, inclined from bottom left to top right, which are disposed in parallel in the circumferential direction and dented by a stepped portion 10 surrounding each panel. And each of six pillars 11, likewise inclined from bottom left to top right, is disposed between two adjacent inclined panels 12*a*.

The tapered portion 6 is an area of the body where there is no uneven surface associated with the vacuum absorbing panels. In addition, since this tapered portion has a relatively steep slope in a limited height range, the shape of this portion is clearly recognizable. A sufficient impression of slimness can be obtained despite the fact that this tapered portion is formed at the upper end of the body, rather than at the middle height position of the body 4.

In this embodiment, the tapered portion 6 has a height of 10 mm, which accounts for 7.5% of the height of the body 4. Despite such a dimension and the position of the tapered portion 6, the inclined panels 12*a* perform the vacuum absorbing function effectively and sufficiently. The tapered portion 6 is narrowed down to an extent that the minimum diameter accounts for 89% of the maximum diameter.

The user can get firm hold of the bottle 1 by putting the thumb and fingers in the vicinities of the waist portion 7, because the tapered portion 6 has a finger-stop function to help the user's grasp.

Corner grooves 15 are formed in two corners among the four corners 13, i.e., in an upper right corner 13 UR and a lower left corner 13 LL where the angles are sharp. These corner grooves 15 are disposed alongside of the corners rounded in an arc, and lie next to the base of the stepped portion 10. A stress analysis under reduced pressure shows that, in a round bottle, such as the one in this embodiment, in which the vacuum absorbing function is performed by the inclined panels 12*a* and the inclined pillars 11, the body 4 twists along the inclined pillars 11 with the increase in depressurization, and the diameter of the body 4 is narrowed down so that the vacuum absorbing function is effectively performed. However, at that time, large tensile stress acts on the pillars 11 along the direction of their inclination. There occurs the concentration of relatively large stress especially in the vicinities of sharp-angled corners (13UR and 13LL). Thus, buckling distortion tends to occur in such a way that the body wall may be buckled locally. The corner grooves 15 perform a reinforcing effect against such deformation to prevent the buckling distortion effectively from occurring.

Figure 2:
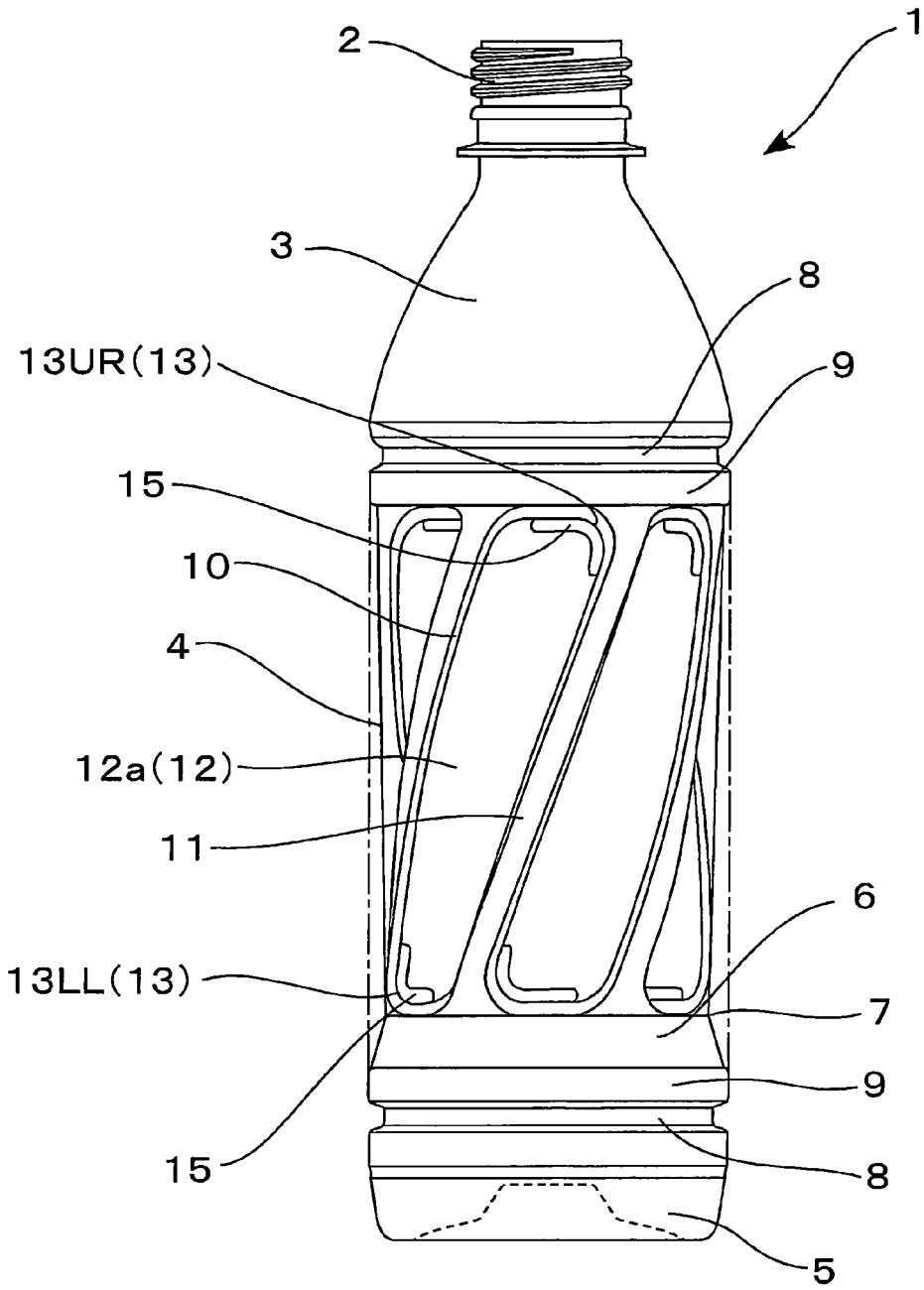
FIG. 2 is a front elevational view of the entire bottle in the second embodiment of this invention.

FIG. 2 is a front elevational view of the entire round bottle made of a synthetic resin in the second embodiment of this invention. The bottle 1 is similar to the bottle in the first embodiment shown in FIG. 1, except that the tapered portion 6 is disposed in the lower end portion of the body 4. Even if the waist portion 7 is formed in the lower end portion, the bottle 1 can give a sufficient impression of slimness, and has an adequate vacuum absorbing function.

Figure 3:
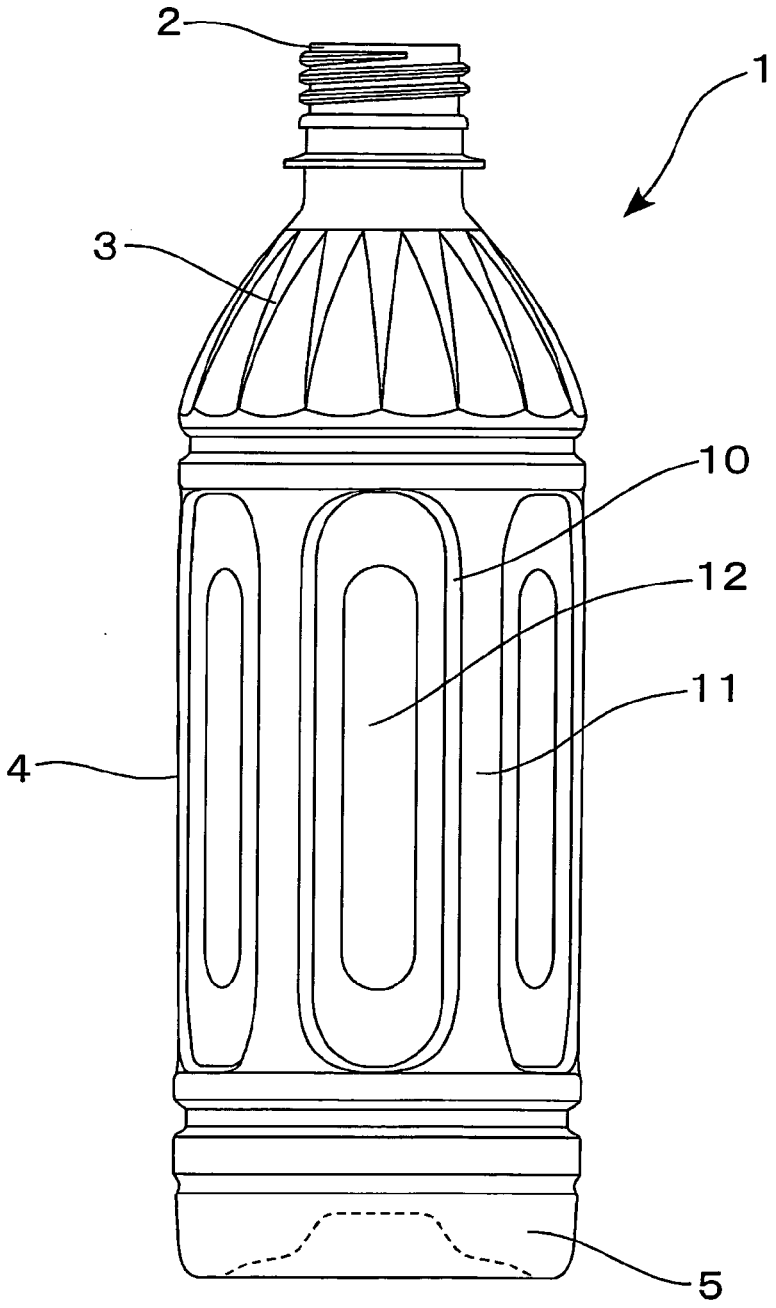
FIG. 3 is a front elevational view of the entire bottle in one example of conventional bottles.

This invention has been described above with respect to the preferred embodiments and the action and effects thereof. However, this invention should not be construed as limitative to the above embodiments. For example, the height range and extent of reduction in the diameter of the tapered portion 6 can be determined while giving consideration to how much slim-looking the body should be and to what extent the vacuum absorbing function is required. The shape of the vacuum absorbing panels is not limited to the inclined shape, but can be vertical, as shown in FIG. 3.

INDUSTRIAL APPLICABILITY

As described above, wide use applications are expected for the round synthetic resin bottle of this invention in which the impression of slimness is created by forming the waist portion without giving damage to the vacuum absorbing function.

The invention claimed is:

1. A round synthetic resin bottle comprising:

a body having a substantially cylindrical shape and divided into a first body portion and a second body portion by a waist portion;

a shoulder disposed at an upper end of the body and having a substantially arcuate shape;

a neck extending upward from the shoulder; and a bottom integrally formed at a lower end of the body, having an inward dent in a center thereof, projecting inwardly toward the body, wherein:

the first body portion and the second body portion taper toward the waist portion, which is a narrowest part of the first body portion and the second body portion;

the body includes:

a tapered portion disposed in the first body portion; and a plurality of dented vacuum absorbing panels formed in the second body portion;

the vacuum absorbing panels are disposed parallel to each other in a circumferential direction of the body and are each dented by a stepped portion surrounding the vacuum absorbing panel;

the plurality of dented vacuum absorbing panels are arranged so that at least a portion of each vacuum absorbing panel is disposed above at least a portion of an adjacent vacuum absorbing panel along a line that is parallel to a central axis of the bottle; and the first body portion has a greater tapering angle than the second body portion.

2. The round synthetic resin bottle according to claim 1, wherein the tapered portion has a height accounting for 15% or less of a body height and a minimum diameter in a range of 75% to 95% of a maximum diameter.

3. The round synthetic resin bottle according to claim 1, wherein the vacuum absorbing panels are inclined uniformly in a certain direction to obtain inclined panels.

4. The round synthetic resin bottle according to claim 1, wherein upper and lower circumferential grooves are formed at upper and lower ends of the body, and the tapered portion is disposed on a side of a center portion of a rotational axis of the body, relative to the upper and lower circumferential grooves.

5. The round synthetic resin bottle according to claim 2, wherein the vacuum absorbing panels are inclined uniformly in a certain direction to obtain inclined panels.

6. The round synthetic resin bottle according to claim 2, wherein upper and lower circumferential grooves are formed at upper and lower ends of the body and the tapered portion is disposed on a side of a center portion of a rotational axis of the body, relative to the upper and lower circumferential grooves.

7. The round synthetic resin bottle according to claim 3, wherein upper and lower circumferential grooves are formed at upper and lower ends of the body and the tapered portion is disposed on a side of a center portion of the rotational axis of the body, relative to the upper and lower circumferential grooves.

8. The round synthetic resin bottle according to claim 5, wherein upper and lower circumferential grooves are formed at upper and lower ends of the body and the tapered portion is disposed on a side of a center portion of the rotational axis of the body, relative to the upper and lower circumferential grooves.

9. The round synthetic resin bottle according to claim 3, wherein a corner groove is formed in at least one corner of at least one of the plurality of dented vacuum absorbing panels.

* * * * *